US009920600B2

(12) United States Patent
McCallum et al.

(10) Patent No.: US 9,920,600 B2
(45) Date of Patent: Mar. 20, 2018

(54) MULTI-STAGE DOWNHOLE HYDRAULIC STIMULATION ASSEMBLY

(75) Inventors: Barry McCallum, Dundee (GB); Jason Swaren, Sugar Land, TX (US); Bradley P. Malone, Manhattan, KS (US); Kevin Mullen, Richmond, TX (US); Kevin Douglas Mauth, Noisy le Roi (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 13/157,978

(22) Filed: Jun. 10, 2011

(65) Prior Publication Data

US 2012/0312536 A1 Dec. 13, 2012

(51) Int. Cl.
*E21B 43/114* (2006.01)
*E21B 43/26* (2006.01)

(52) U.S. Cl.
CPC ..... *E21B 43/114* (2013.01); *E21B 43/26* (2013.01)

(58) Field of Classification Search
CPC ..... E21B 43/114; E21B 43/16; E21B 43/162; E21B 43/25; E21B 43/26
USPC ..... 166/305.1, 308.1, 373, 378, 381, 177.5, 166/319, 55, 298
See application file for complete search history.

(56) References Cited

U.S. PATENT DOCUMENTS 5,890,540 A 4/1999 Pia et al.
6,378,612 B1 4/2002 Churchill
6,607,607 B2 8/2003 Walker et al.
6,820,697 B1 11/2004 Churchill
6,923,871 B2 8/2005 Walker et al.
6,982,008 B2 1/2006 Walker et al.
7,267,172 B2 * 9/2007 Hofman ..... 166/281
7,311,153 B2 12/2007 McKee et al.
7,337,283 B2 2/2008 Susaki et al.
7,497,259 B2 3/2009 Lesing et al.
7,655,096 B2 2/2010 Walker et al.
7,673,673 B2 * 3/2010 Surjaatmadja et al. ..... 166/55
7,849,924 B2 * 12/2010 Surjaatmadja et al. ..... 166/298
7,874,365 B2 * 1/2011 East et al. ..... 166/305.1
(Continued)

FOREIGN PATENT DOCUMENTS

CA 2311254 C 3/2010
CN 101979823 A 2/2011
(Continued)

OTHER PUBLICATIONS

Extended European Search Report issued in European Patent Application No. 12171400.0 dated Aug. 29, 2016; 7 pages.
(Continued)

*Primary Examiner* — Caroline N Butcher
(74) *Attorney, Agent, or Firm* — Michael L. Flynn; Robin Nava

(57) ABSTRACT

An assembly for performing multiple downhole hydraulic stimulation applications in a well. The different applications may be performed without removal of the assembly from the well between the different applications. So, for example, even a hydraulic perforating application may be performed with prior or subsequent clean-out applications. Yet, there is no need to remove the assembly for manual surface adjustment of the hydraulic perforating tool in order to allow for such clean-outs.

14 Claims, 6 Drawing Sheets

(56) References Cited

U.S. PATENT DOCUMENTS

| | | | | |
|---|---|---|---|---|
| 7,963,331 | B2 * | 6/2011 | Surjaatmadja et al. | 166/285 |
| 8,312,925 | B2 * | 11/2012 | Trummer et al. | 166/278 |
| 2004/0055749 | A1 * | 3/2004 | Lonnes et al. | 166/298 |
| 2006/0118301 | A1 | 6/2006 | East, Jr. et al. | |
| 2006/0201675 | A1 * | 9/2006 | Ferguson et al. | 166/298 |
| 2007/0051517 | A1 | 3/2007 | Surjaatmadja et al. | |
| 2007/0284106 | A1 * | 12/2007 | Kalman et al. | 166/298 |
| 2009/0032255 | A1 * | 2/2009 | Surjaatmadja et al. | 166/281 |
| 2009/0308588 | A1 * | 12/2009 | Howell et al. | 166/66.4 |
| 2010/0044041 | A1 * | 2/2010 | Smith et al. | 166/280.1 |
| 2010/0122817 | A1 * | 5/2010 | Surjaatmadja et al. | 166/308.1 |
| 2010/0126724 | A1 | 5/2010 | Surjaatmadja et al. | |
| 2010/0200226 | A1 * | 8/2010 | Trummer et al. | 166/255.1 |
| 2011/0174491 | A1 * | 7/2011 | Ravensbergen et al. | 166/308.1 |
| 2012/0097398 | A1 * | 4/2012 | Ravensbergen et al. | 166/308.1 |
| 2012/0199353 | A1 * | 8/2012 | Fermaniuk et al. | 166/305.1 |
| 2013/0180721 | A1 * | 7/2013 | Getzlaf et al. | 166/308.1 |

FOREIGN PATENT DOCUMENTS

| | | | |
|---|---|---|---|
| EP | 1689969 | B1 | 3/2010 |
| GB | 2351511 | B | 10/2003 |
| WO | 2005049960 | A1 | 6/2005 |
| WO | 2007060449 | A2 | 5/2007 |
| WO | 2009024753 | A1 | 2/2009 |

OTHER PUBLICATIONS

Examination Report issued in GCC Patent Application No. GC 2012-21483 dated Dec. 7, 2015; 4 pages.
Examination Report issued in GCC Patent Application No. GC 2012-21483 dated May 24, 2016; 5 pages.

* cited by examiner

MULTI-STAGE DOWNHOLE HYDRAULIC STIMULATION ASSEMBLY

FIELD

Embodiments described relate to stimulation operations in downhole production zones of a well. More specifically, multi-stage hydraulic isolating, perforating, clean-out and fracturing tools and techniques are detailed. Such multiple applications may even be performed on a single wellbore tubular trip into the well delivering an embodiment of a hydraulic treatment assembly therefor.

BACKGROUND

The statements in this section merely provide background information related to the present disclosure and may not constitute prior art.

Exploring, drilling and completing hydrocarbon and other wells are generally complicated, time consuming and ultimately very expensive endeavors. As a result, over the years well architecture has become more sophisticated where appropriate in order to help enhance access to underground hydrocarbon reserves. For example, as opposed to wells of limited depth, it is not uncommon to find hydrocarbon wells exceeding 30,000 feet in depth. Furthermore, as opposed to remaining entirely vertical, today's hydrocarbon wells often include deviated or horizontal sections aimed at targeting particular underground reserves.

While such well depths and architecture may increase the likelihood of accessing underground hydrocarbons, other challenges are presented in terms of well management and the maximization of hydrocarbon recovery from such wells. For example, during the life of a well, a variety of well access applications may be performed within the well with a host of different tools or measurement devices. However, providing downhole access to wells of such challenging architecture may require more than simply dropping a wireline into the well with the applicable tool located at the end thereof. Thus, wellbore tubulars such as coiled tubing are frequently employed to provide access to wells of such challenging architecture.

Coiled tubing operations are particularly adept at providing access to highly deviated or tortuous wells where gravity alone fails to provide access to all regions of the wells. During a coiled tubing operation, a spool of pipe (i.e., a coiled tubing) with a downhole tool at the end thereof is slowly straightened and forcibly pushed into the well. This may be achieved by running coiled tubing from the spool and through a gooseneck guide arm and injector which are positioned over the well at the oilfield. In this manner, forces necessary to drive the coiled tubing through the deviated well may be employed, thereby delivering the tool to a desired downhole location.

With different portions of the well generally accessible via coiled tubing, stimulation of different well zones may be carried out in the form of perforating and fracturing applications. For example, a perforating gun may be suspended at the end of the coiled tubing and employed for forming perforations through the well wall and into the surrounding formation. Subsequent hydraulic fracturing applications may be undertaken in order to deliver proppant and further encourage hydrocarbon recovery from the formation via the perforations.

In some circumstances, a hydraulic jetting tool may be substituted for a more conventional perforating gun. A hydraulic jetting tool may comprise a solid body tool with jetting ports through sidewalls thereof and a ball seat positioned therebelow. Thus, once the tool is located at the target location for perforating, a ball may be pumped from surface and landed on the seat, thereby activating hydraulic jetting through the ports. Such a tool may be utilized where the nature of the surrounding formation dictates more effective perforating via a jetting tool.

Regardless of the particular perforating tool employed, the sequential nature of stimulation remains substantially the same. That is, coiled tubing is outfitted with a perforating tool which is delivered downhole to a target location to form perforations. The coiled tubing is then withdrawn from the well and the perforating tool swapped out for a hydraulic fracturing tool which is subsequently delivered to the same target location for follow-on fracing. However, even where the perforating tool is a hydraulic jetting tool, it may not subsequently be employed for the lower pressure hydraulic fracturing. That is to say, once the ball has landed, it is stably and irreversibly held in place while the tool is downhole, so as to ensure reliable jetting through the ports.

Unfortunately, the time it takes to run into and out of the well with the coiled tubing for the different stages of the stimulation can be quite costly, particularly when considering wells of greater depths or more challenging architectures. For example, it is not uncommon today to see wells of 10 to 20 different stimulated zones. Considering that in an offshore environment it may take on average about a week per zone to complete stimulation, the repeated trips into the well for tool change-outs may add up to several hundred thousand dollars of lost time. This is particularly true when considering the additional time required where clean-out between perforating and fracturing is undertaken or when considering separate well trips for zonal isolation in advance of stimulation.

SUMMARY

A method of performing an application in a well is detailed. The application takes place through a wellbore tubular which is utilized to deliver an assembly with a ported tool to a target location. Ports of the tool may be opened for a first hydraulic treatment of the location at a first hydraulic setting. The tubular is then retained in the well to perform a second hydraulic treatment with the assembly at a second hydraulic setting.

DETAILED DESCRIPTION

Embodiments are described with reference to certain multi-stage downhole hydraulic applications. In particular, downhole isolating and stimulation applications are described. However, a variety of different downhole hydraulic applications may make use of different embodiments of a hydraulic treatment assembly as detailed herein. For example, while deployment of a mechanical packer, perforating and other stimulation techniques are employed, any number of additional or alternative downhole hydraulic applications such as water jet cutting may also be undertaken. Regardless of the particular applications undertaken, embodiments of the downhole assembly employed will include use of a jetting tool capable of forming perforations while also being reversibly actuatable. So, for example, applications with tools uphole and downhole of the jetting tool may also be performed without requiring that the entire assembly first be removed from the well for adjustment of the jetting tool.

Figure 1:
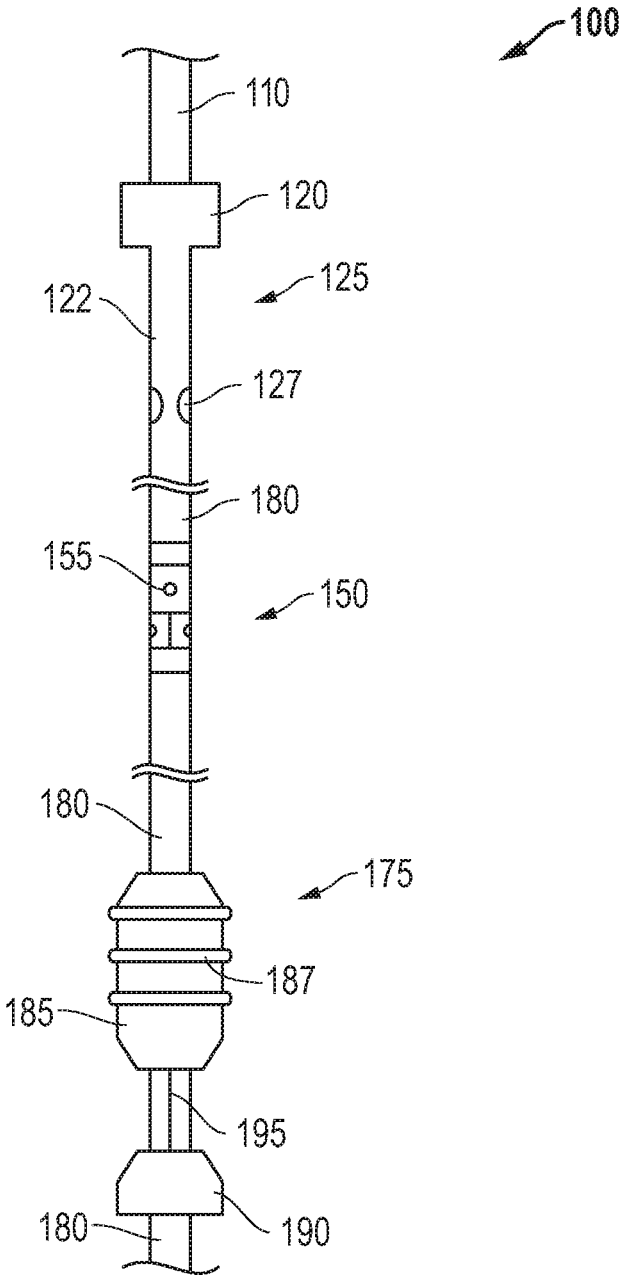
FIG. 1 is a schematic front view of an embodiment of a multi-stage hydraulic treatment assembly for performing various downhole applications on a single trip into a well.

Referring now to FIG. 1, a front view of an embodiment of a multi-stage hydraulic treatment assembly 100 is shown. The assembly 100 is configured for performing various downhole applications on a single trip into a well 380 such as that depicted in FIG. 3. In this regard, the assembly 100 is outfitted with a reversibly actuatable hydraulic jetting tool 150 with nozzles 155 capable of forming perforations 475 as depicted in FIG. 4B. That is to say, the tool 150 may be hydraulically actuated for such an application and effectively deactivated thereafter to allow a hydraulic application through another tool such as the depicted fracturing tool 125. By the same token, the fracturing tool 125 or another tool may also be used in advance of the jetting tool 150.

Due to the ability of the hydraulic jetting tool 150 to be effectively actuated and deactivated, the assembly 100 may be constructed with a number of different tools for use in downhole operations. So, for example, in the embodiment shown, a mechanical packer unit 175 is provided downhole of the jetting tool 150. Similarly, the assembly 100 also accommodates the above-noted fracturing tool 125 above the jetting tool 150. Each of the fracturing tool 125, the packer unit 175, and the jetting tool 150 may be used in whatever sequential order called for by downhole operations, for example, as detailed with reference to FIGS. 4A-4C herein. That is, concern over actuation of the jetting tool 150 leading to permanent deactivation of other tools, without removal of the assembly 100 from the well 380, is obviated by the reversible nature of the jetting tool 150 (see FIG. 3).

Continuing with reference to FIG. 1, the assembly 100 is shown secured to coiled tubing 110 for downhole conveyance. However, in other embodiments alternative forms of hydraulic tubular conveyance, such as jointed pipe, may be utilized.

Upon conveyance to a downhole destination, zonal isolation may be sought, for example, in advance of stimulation operations. Thus, the noted mechanical packer unit 175 is provided. However, by the same token, a bridge plug, slotted liner, or any number of zonal structures may be outfitted at the downhole end of the assembly 100 for deployment. In the case of the depicted mechanical packer unit 175, a packer 185 with expandable seals 187 is provided along with a setting mechanism 190 which may be hydraulically controlled through the assembly 100. More specifically, the setting mechanism 190 of FIG. 1 is a hydrostatic set module with a hydraulic line 195 to the packer 185 to direct setting thereof. Actuation of the module itself may be directed hydraulically through the interior of a tubular 180 serving as a central mandrel for the entire assembly 100.

Upon isolation or other preliminary measures, perforating may take place through the jetting tool 150 as alluded to above. In the embodiment shown, the tool 150 is outfitted with four nozzles 155 which are vertically offset from one another as with a conventional embodiment. However, alternative orientations or total number of nozzles 155 may also be employed. Regardless, upon activation as detailed with respect to FIG. 2 below, a conventional perforating fluid may be pumped internally through the coiled tubing 110, fracturing tool 125, tubular 180, and eventually out the nozzles 155 to initiate perforating.

Following perforating, the assembly 100 may be positioned for clean-out and/or fracturing through opened valves 127 in the fracturing tool 125. So, for example, a fluid, such as water, may be pumped through the interior of the coiled tubing 110, past a hydraulic sub 120 of the fracturing tool 125 and out the opened valves 127 for clean-out of debris. Note that the pumping of water in this manner may take place at an increased rate as compared to perforating through the jetting tool 150. However, the larger size orifices of the valves 127 as compared to the jetting nozzles 155 effectively deactivates the jetting tool 150 as described further below. Additionally, a conventional 20/40, 100 mesh fracturing sand, fibers, and other constituents may be added to the fluid at surface, perhaps along with further modification of pump rate. In this manner, a transition from a clean-out application to a fracturing application may be made via the same fracturing tool 125.

Figure 3:
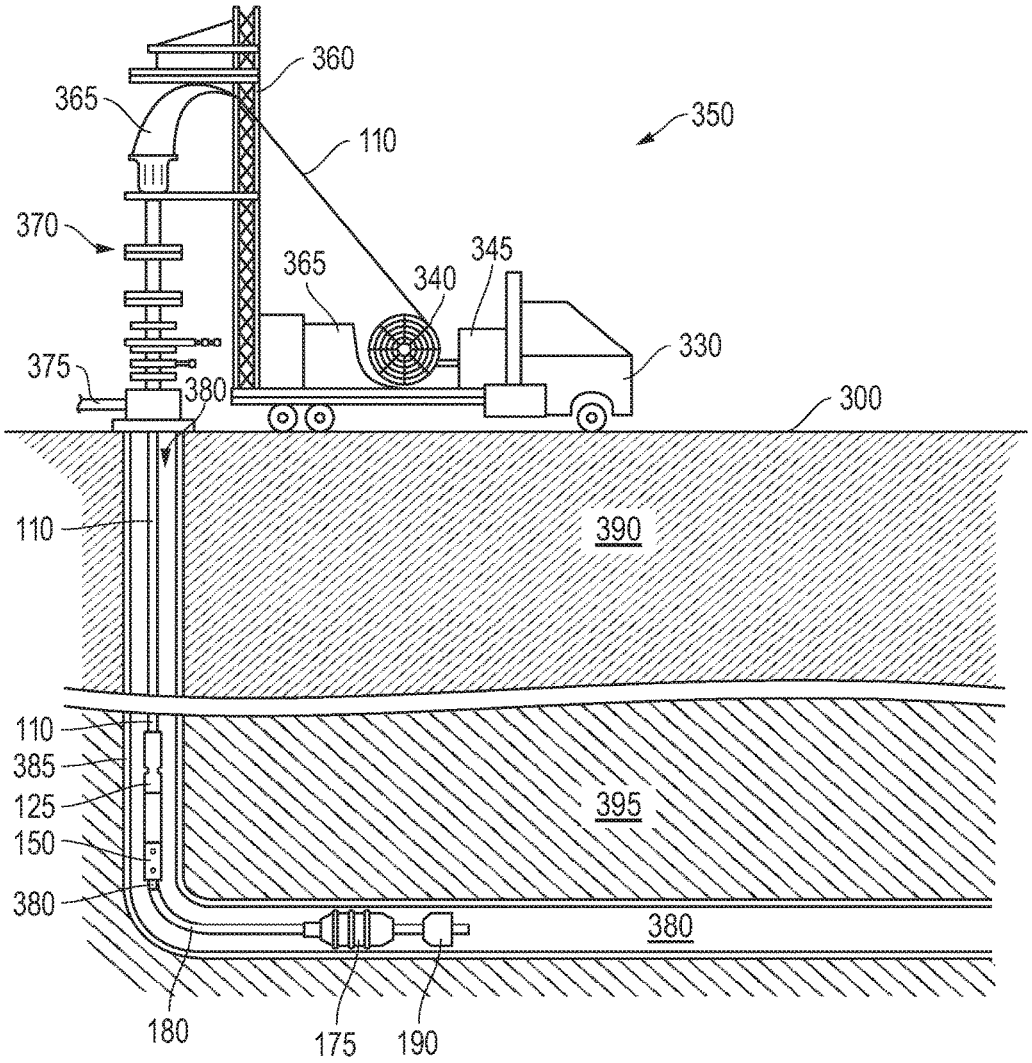
FIG. 3 is an schematic overview of an oilfield having a well accommodating the treatment assembly of FIG. 1 therein.

With added reference to FIG. 3 and as alluded to above, the move from one application to the next is achieved without removal of the entire assembly 100 from the well 380 in spite of an intervening use of the hydraulic jetting tool 150. That is to say, isolation may precede perforating with the tool 150, and clean-out and/or fracturing may take place thereafter without the need to remove the assembly 100 for deactivation of the tool 150. As indicated, this is possible due to the reversible nature of the tool 150 as described below.

Figure 2:
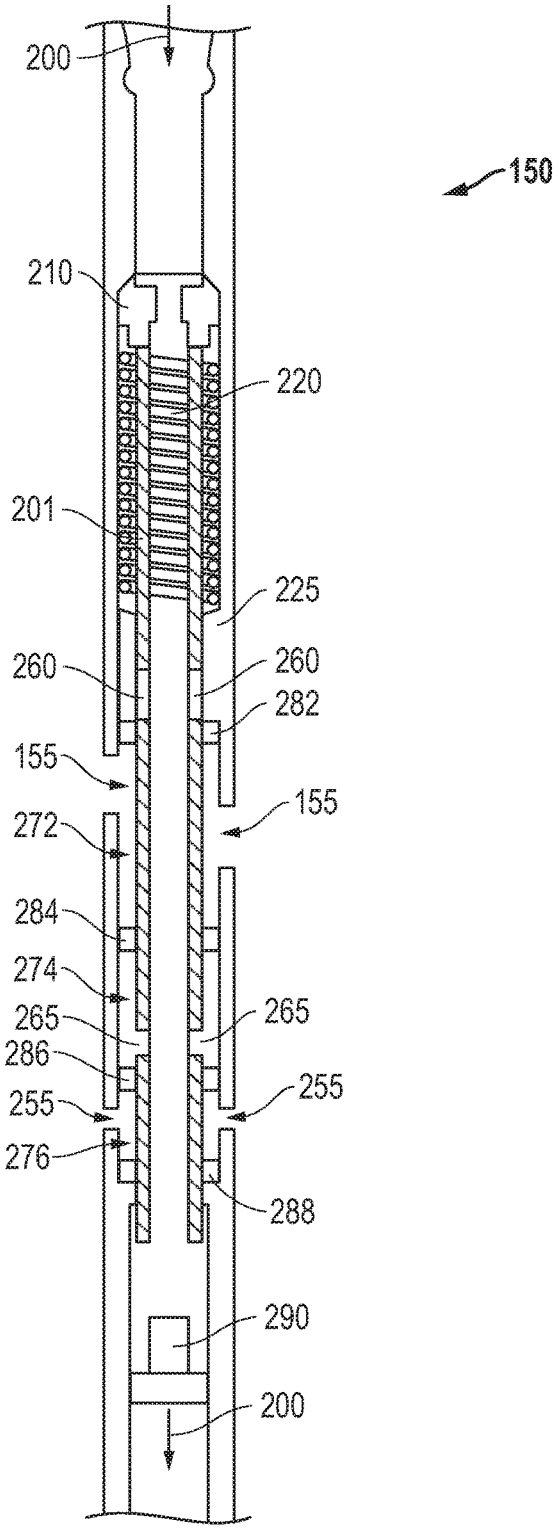
FIG. 2 is a side cross-sectional schematic view of a hydraulic perforating tool of the treatment assembly of FIG. 1.

Referring now to FIG. 2, side cross-sectional view of the hydraulic jetting tool 150 is shown revealing its reversible nature. That is, as opposed to actuation by way of a ball hydraulically delivered to a seal below the jetting nozzles 155, 255, an internal hydraulic mandrel 201 is provided. This mandrel 201 is equipped with openings 260, 265 which may be reversibly aligned with the noted nozzles 155, 255 for their actuation and deactivation as the case may be. That is to say, with the openings 260, 265 out of alignment with the nozzles 155, 255, a hydraulic application may take place below the tool 150, as evidenced by the pass through of fluid flow 200. Subsequent alignment of the openings 260, 265 with the nozzles 155, 255 may allow for jetting (e.g. perforating) through the nozzles 155, 255. Indeed, subsequent lower pressure hydraulic applications above the tool 150 may take place, even while maintaining the noted alignment. Such is the case with a clean-out or fracturing application through the fracturing tool 125 of FIG. 1 as noted above and detailed further below.

Continuing with reference to FIG. 2, a fluid flow in a downhole direction indicated by an arrow 200 is shown passing through the entire tool 150 without actuation of the nozzles 155, 255. However, a hydraulically responsive orifice head 210 is provided which is biasingly coupled to the noted mandrel 201 as governed through a spring 220. Thus, the orifice head 210 and spring 220 may be configured for shifting of the mandrel 201 upon introduction of a given flow rate. So, for example, where a flow rate of less than about 2 barrels per minute (BPM) is pumped through the tool 150 in the direction 200, the mandrel 201 may be left in the nozzle closed alignment as shown. However, when a flow rate exceeding 2 BPM is introduced in the direction 200, the head 210 and spring 220 may move downhole, shifting the mandrel 201 into nozzle open alignment as described below.

As indicated, a nozzle open alignment of the mandrel openings 260, 265 with the nozzles 155, 255, takes place as the mandrel 201 shifts downhole. More specifically, as the mandrel 201 shifts downhole, the uphole openings 260 of the mandrel 201 are moved into alignment with an uphole chamber 272 defined by uphole seals 282, 284. This chamber 272 in turn, is in fluid communication with the uphole nozzles 155, thereby allowing for jet perforating therethrough. Similarly, the downhole openings 265 are simultaneously moved from alignment with an isolated central chamber 274 and into alignment with a downhole chamber 276 defined by downhole seals 286, 288. Thus, with the downhole chamber 276 in fluid communication with the downhole nozzles 255, jet perforating may also take place therethrough.

It is worth noting that the central chamber 274, defined by both uphole 284 and downhole 286 seals, is provided so that while in the nozzle closed position, the downhole openings 265 remain sealed off from possible communication with the downhole nozzles 255. Additionally, also note that with a sufficiently low flow rate, the flow in the direction 200 is allowed to pass through the entire tool 150 and through a blank orifice 290 thereof, as indicated in FIG. 2, perhaps to hydraulically direct further downhole applications. However, by the same token, even once the open nozzle position is achieved, higher flow rate applications above and below the tool 150 may nevertheless take place. For example, higher flow rate, lower pressure applications such as a 5-6 BPM clean-out, or perhaps packer setting or other applications may take place. That is, due to lower pressures involved, no more than minimal fluid leakage would take place through the nozzles 155, 255 without affect on the higher flow rate applications.

Referring now to FIG. 3, an overview of an oilfield 300 is depicted with a well 380 accommodating the overall treatment assembly 100 of FIG. 1 therein. In the embodiment shown, the well 380 traverses various formation layers 390, 395 and is outfitted with a casing 385 throughout, even into a lateral leg region. However, in alternate configurations, this region may remain open-hole in nature. Regardless, coiled tubing 110 is employed for conveyance of the assembly 100 through the well 380, including positioning of a mechanical packer 175 within the noted lateral leg region. Thus, the setting mechanism 190 may ultimately be employed to direct isolation of this region with the packer 175 (see also FIG. 4A). However, as indicated above, further downhole activity, such as clean-out below the packer 175 by way of the assembly 100 may precede packer setting.

Continuing with reference to FIG. 3, the assembly 100 includes tubular structure 180 for joining the packer 175 to the jetting tool 150. Indeed, a detachable coupling 380 is shown disposed therebetween. Thus, once the packer 175 is set, the tool 150 and the remainder of the assembly 100 may be detached from the set packer 175 and utilized elsewhere in the well 380. In the embodiment shown, perforating via the jetting tool 150 is to take place immediately above the packer 175 and into the lower formation layer 395 as described above. However, with the tool 150 detached from the packer 175, other formation locations may also be targeted.

Subsequent clean-out, fracturing or other stimulation applications may take place through the fracturing tool 125, with fluid, debris and other material produced through a production line 375 at surface. Indeed, at the oilfield 300 a host of surface equipment 350 is provided for directing and driving the use of the entire treatment assembly 100. As shown, a mobile coiled tubing truck 330 is delivered to the well site accommodating a coiled tubing reel 340 along with a control unit 355 for directing the deployment of the assembly 100 as well as hydraulic applications therethrough. A pump 345 is also provided for maintaining flow through the coiled tubing 110 as well as for introducing application specific constituents such as proppant, fibers and/or sand as needed.

In the embodiment shown, the truck 330 is outfitted with a mobile rig 360 which accommodates a conventional gooseneck injector 365. The injector 365 is configured for driving the coiled tubing 110 and assembly 100 through valve and pressure control equipment 370, often referred to as a "Christmas tree". Thus, positioning is provided for the carrying out of downhole hydraulic applications as detailed further below. Further, as noted above, separate multi-stage operations may proceed without the need to remove and adjust the assembly 100, particularly the jetting tool 150 between different hydraulic applications.

Figure 4A:
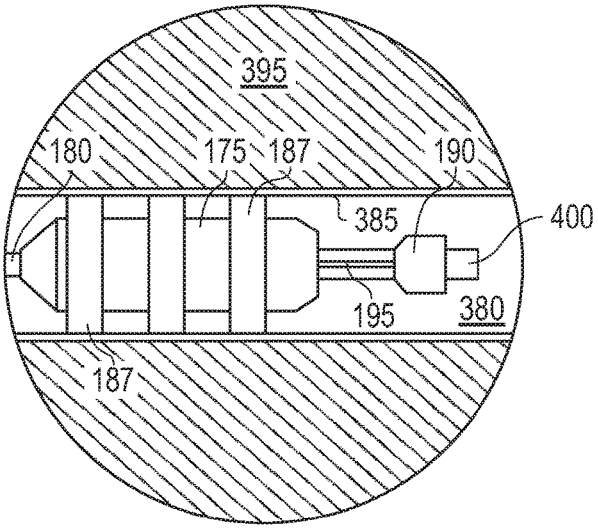
FIG. 4A is an enlarged depiction of a horizontal section of the well of FIG. 3 having a mechanical packer of the treatment assembly set therein.
Figure 4B:
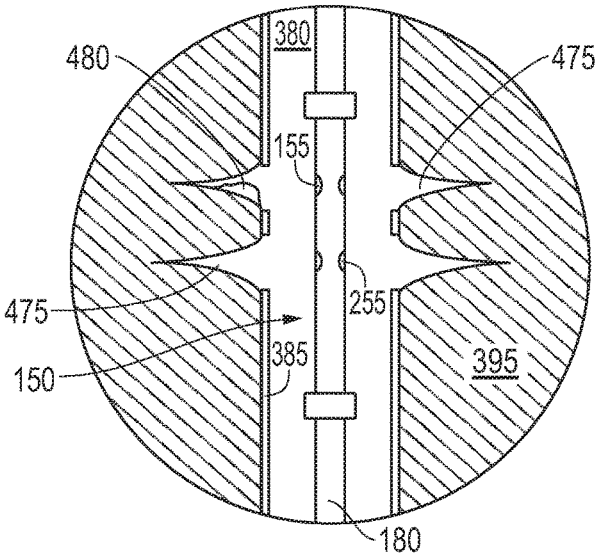
FIG. 4B is an enlarged depiction of a vertical section of the well of FIG. 3 having perforations formed thereat via the perforating tool of the assembly.
Figure 4C:
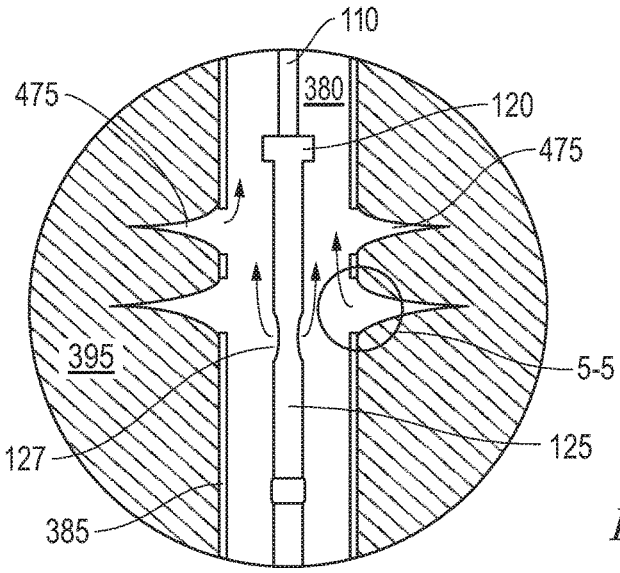
FIG. 4C is an enlarged view of a clean-out application by a fracturing tool of the assembly directed at the perforations of FIG. 4B.

Referring now to FIGS. 4A-4C, sequential multi-stage stimulation operations in the well 380 with the treatment assembly 100 of FIG. 3 as alluded to above are shown in greater detail. More specifically, FIG. 4A reveals the setting of the mechanical packer 175 in the horizontal region of the well 380. This is followed by the perforating of the well 380 in a vertical region with the jetting tool 150 as depicted in FIG. 4B. Subsequently, a clean-out of the perforations 475 may be performed by the fracturing tool 125 as depicted in FIG. 4C. Of course, additional stimulation through the fracturing tool 125 is also possible, such as acidizing or actual fracturing (see the frac-matrix support 500, evident in FIG. 5).

With specific reference to FIG. 4A, an enlarged depiction of a horizontal section of the well 380 is shown with the noted mechanical packer 175 set therein. That is, in contrast to the depiction of FIG. 3, the seals 187 are fully expanded into engagement with the casing 385 so as to provide isolation below the packer 175. As indicated above, this may be achieved by way of hydraulic actuation of a setting mechanism 190, which in turn sets the packer 175. In the embodiment shown, the setting mechanism 190 may be a hydrostatic set module linked to the packer 175 through a hydraulic line 195 to drive the setting. However, in other embodiments, the mechanism 190 may be activated through a conventional 'ball drop' or other suitable technique.

Continuing with reference to FIG. 4A, note the presence of a terminal nozzle 400 located below the packer 175. In one embodiment, such a nozzle may be employed for clean-out in advance of packer setting. That is, packer setting via the setting mechanism 190 (or perforating through the jetting tool 150 (see FIG. 4B)) may be responsive to certain hydraulic profiles and/or pump rates. However, different hydraulic profiles and/or pump rates may be utilized for clean-outs. So, for example, pump rates outside of a 1-3 BPM rate or so may be utilized for clean-outs, whereas such a 1-3 BPM rate may be utilized for perforating as described above. Meanwhile, a ball-drop technique, sonic profile or other suitable hydraulic actuation means may be utilized for packer setting via the mechanism 190 or other alternative downhole application.

Referring now to FIG. 4B, an enlarged depiction of a vertical section of the well 380 is shown with the noted perforations 475 formed via the perforating tool 150. As indicated, the perforations 475 may be formed by way of pumping a flow of 1-3 BPM through the tool 150 to actuate the nozzles 155. Conventional perforating sand and other material may be pumped along with fluid flow as directed from surface so as to form the perforations 475 through the casing 385 and into the formation 395. The effectiveness of the perforating may be enhanced due to the zonal isolation provided by the set packer 175 therebelow (see FIG. 4A).

While effective perforations 475 may serve as an aid to production from the formation 395, a certain amount of debris 480 may remain and serve as a hindrance to recovery. Thus, as depicted in FIG. 4C, further clean-out may be in order. FIG. 4C reveals an enlarged view of a clean-out application by the above detailed fracturing tool 125. In one embodiment, the tool 125 may be a conventional multi-cycle circulating valve. Regardless, a clean-out takes place, generally at a pump rate of between about 4-7 BPM, debris 480 and other fluid may be flowed uphole and eventually produced through the production line 375 at surface (see FIG. 3). Once more, as noted above, this clean-out may be initiated through the fracturing tool 125 following the perforating with the jetting tool 150, without any need for removal of the jetting tool 150 from the well 380.

Figure 5:
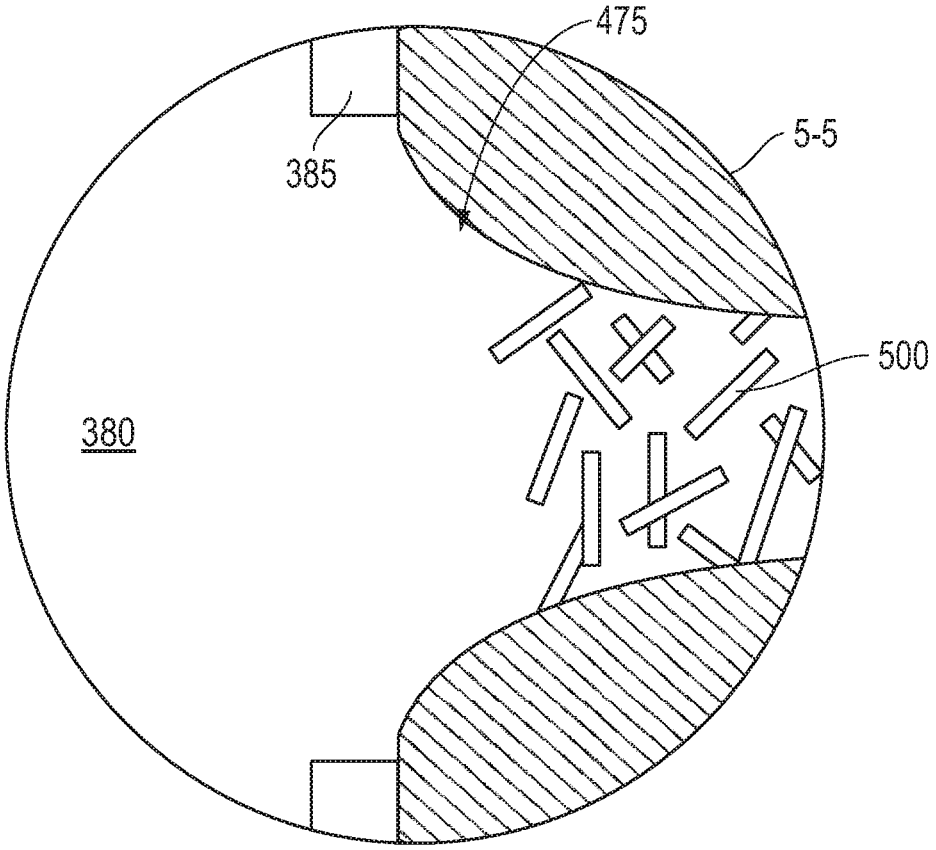
FIG. 5 is an enlarged view of a perforation taken from 5-5 of FIG. 4C revealing frac-matrix support following a fracturing application with the fracturing tool.

Referring now to FIG. 5, an enlarged view of a perforation 475 is depicted, taken from 5-5 of FIG. 4C. In this view, frac-matrix support 500 is shown following a fracturing application with the fracturing tool 125 of FIG. 4C. That is, after a clean-out via the tool 125 as noted above, fibers, proppant and other constituents may be added to the flow and/or the flow rate adjusted for fracturing to proceed. The end result, represented in the perforation 475 of FIG. 5, may be a matrix support 500 of structure to help hold open and enhance hydrocarbon recovery from the perforation 475 and into the main body of the well 380 for production to surface.

Figure 6:
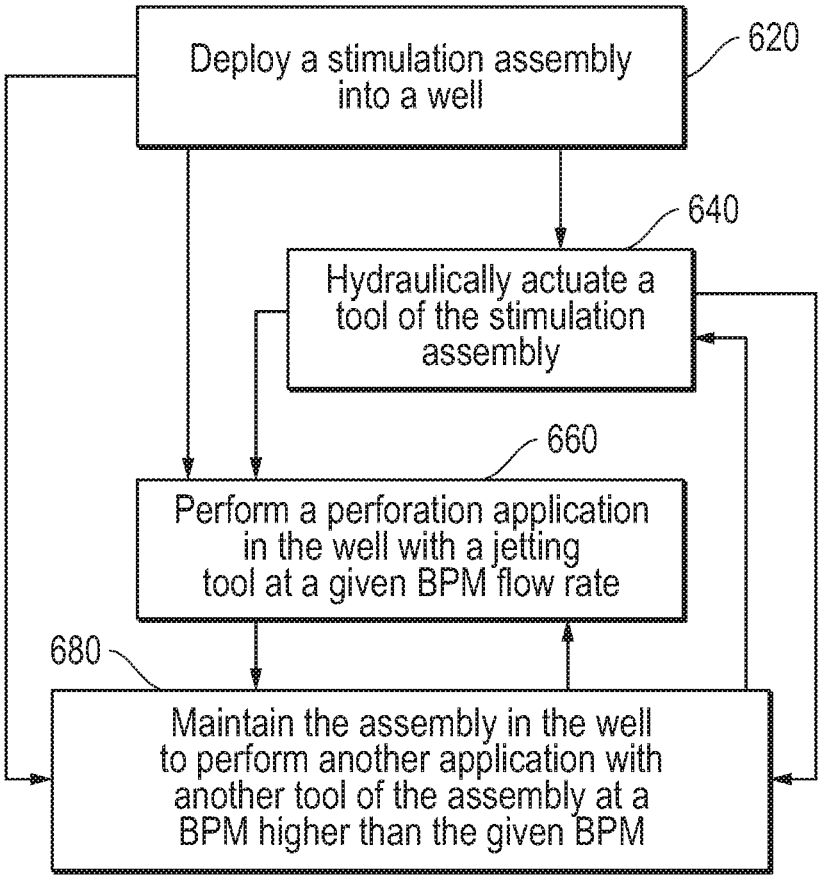
FIG. 6 is a flow-chart summarizing an embodiment of employing a multi-stage downhole hydraulic treatment assembly.

Referring now to FIG. 6, a flow-chart summarizing an embodiment of employing a multi-stage downhole hydraulic stimulation assembly is depicted. As indicated, the assembly is deployed into the well and an initial actuation may take place such as the hydraulic setting of a mechanical packer (see 620, 640). The deployment may take place over coiled tubing, jointed pipe or other appropriate hydraulic tubular conveyance. Additionally, the hydraulic actuation may take place via conventional ball-drop, wireless acoustics or sonic signaling, the particular mode dependent upon the type of setting mechanism utilized. Of course, the tool may also be a downhole tool other than a mechanical packer, bridge plug or other isolating mechanism. Furthermore, a clean-out application as indicated at 680 may take place before, after, or in lieu of the initial actuation of this downhole tool.

Regardless of initial stimulation measures, subsequent stages may include the performing of a perforating application via a jetting tool as indicated at 660. This perforating may take place at a comparatively high pressure but low BPM flow rate. Perhaps most notably, however, is the fact that following perforating, the entire assembly may be maintained in the well as indicated at 680 regardless of the particular next stage hydraulic application to be undertaken (e.g. such as a higher BPM clean-out).

Embodiments described hereinabove include a downhole treatment and/or stimulation assembly that may be utilized for multi-stage applications in a given well zone without requiring that the assembly be removed between stages of the applications. More specifically, where one stage includes perforating, the assembly need not be removed for adjustment of the perforating tool before or after the perforating. Rather, the application stage to be undertaken before or after the perforating may be undertaken without compromise even in the absence of removal of the perforating tool to surface.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. For example, embodiments depicted herein reveal a perforating tool which is reversibly actuatable by way of a position shifting internal hydraulic mandrel. However, other techniques may be utilized to allow for reversible actuation of the perforating tool. Such alternatives may include use of ball actuation and recovery through a flow back technique that avoids the need to remove the tool from the well for deactivation. Furthermore, the foregoing description should not be read as pertaining only to the precise structures described and shown in the accompanying drawings, but rather should be read as consistent with and as support for the following claims, which are to have their fullest and fairest scope.

We claim:

1. A multi-stage hydraulic stimulation assembly comprising:

a tool for performing at least one hydraulic application in a well at a first hydraulic flow rate through the tool in a downhole direction by directing the hydraulic flow into the well;

a jetting tool for performing a hydraulic perforating application in the well at a second hydraulic flow rate through the jetting tool in the downhole direction; and a zonal isolation apparatus coupled to the jetting tool for isolating a zone of the well, the assembly to be maintained in the well between the perforating application and the hydraulic application without blocking fluid flow through the assembly, wherein the assembly is biased by a biasing member in a position for performing the hydraulic application and configured to reversibly shift between the position for performing the perforating application and a position for performing the hydraulic application based on the rate of fluid flow in the downhole direction through the tool and the jetting tool of the assembly and the operation of the biasing member.

2. The assembly of claim 1 further comprising a tubular conveyance attached to the assembly for deployment of the assembly into the well.

3. The assembly of claim 2 wherein the tubular conveyance comprises coiled tubing or jointed pipe.

4. The assembly of claim 2 wherein the tool comprises a fracturing tool, and wherein the zonal isolation apparatus comprises mechanical packer unit, a bridge plug or a slotted liner.

5. The assembly of claim 4 wherein the mechanical packer unit comprises:

a mechanical packer with expandable seals; and a setting mechanism coupled to the packer for setting thereof as the other hydraulic application.

6. The assembly of claim 4 wherein the fracturing tool comprises a multi-cycle circulating valve to direct the hydraulic application with the second hydraulic flow setting at a lower pressure and higher flow rate than the first hydraulic flow setting.

7. The assembly of claim 6 wherein the hydraulic application comprises one of a fracturing application and a clean-out application.

8. The assembly of claim 6 further comprising a terminal nozzle located downstream of the zonal isolation apparatus, the terminal nozzle configured for a clean-out operation.

9. A method of performing an application in a well, the method comprising:

delivering a hydraulic assembly with a jetting tool and a hydraulically actuatable tool to a target location in a well by way of a tubular conveyance;

directing a perforating fluid through the hydraulic assembly and through nozzles of the jetting tool into the well for a hydraulic perforating application at a first hydraulic flow setting at the target location by directing fluid flow in a downhole direction through a multi-cycle circulating valve by shifting openings of a biased internal mandrel of the assembly into a second position in alignment with the nozzles, the internal mandrel biased by a biasing member to first position not adjacent the nozzles;

directing another fluid through the hydraulic assembly in the downhole direction and performing another hydraulic application with the assembly at a second hydraulic flow setting by reversibly shifting the valve, with the biasing member, from the second position to the first position, the second hydraulic flow setting at a higher flow rate and lower pressure than the perforating application, the higher flow rate shifting the multi-cycle circulating valve and directing the another fluid into the well through at least another valve; and retaining the assembly in the well between the perforating application and the hydraulic application without blocking fluid flow through the hydraulic assembly.

10. The method of claim 9 wherein the other hydraulic application is one of a zonal isolation application, an acidizing application, a clean-out application, and a fracturing application.

11. The method of claim 10 further comprising:

circulating a fluid through the multi-cycle circulating valve for the clean-out application; and pumping fracturing constituents into the fluid and through the multi-cycle circulating valve to transition from the clean-out application to the fracturing application.

12. The method of claim 9 wherein shifting comprises introducing a flow rate through the tool of between about 1 BPM and about 3 BPM for the first hydraulic setting.

13. The method of claim 9 further comprising changing the flow rate to the first hydraulic flow setting to direct fluid flow back to the nozzles and performing another perforating operation after completion of the other hydraulic operation.

14. The method of claim 9 further comprising directing a fluid through the assembly in the downhole direction and into the well beyond the assembly through a terminal nozzle.

* * * * *